US006500597B1

(12) United States Patent
Patel et al.

(10) Patent No.: US 6,500,597 B1
(45) Date of Patent: Dec. 31, 2002

(54) TONER COAGULANT PROCESSES

(75) Inventors: Raj D. Patel, Oakville (CA); Lori A. Rettinger, Waterloo (CA); Michael A. Hopper, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/922,263

(22) Filed: Aug. 6, 2001

(51) Int. Cl.[7] ..... G03A 9/00
(52) U.S. Cl. ..... 430/137.14; 523/335
(58) Field of Search ..... 430/137.14; 523/335

(56) References Cited

U.S. PATENT DOCUMENTS

| | | | | |
|---|---|---|---|---|
| 3,674,736 | A | 7/1972 | Lerman et al. | 260/41 R |
| 4,137,188 | A | 1/1979 | Uetake et al. | 252/62.1 P |
| 4,558,108 | A | 12/1985 | Alexandru et al. | 526/340 |
| 4,797,339 | A | 1/1989 | Maruyama et al. | 430/109 |
| 4,981,675 | A | 1/1991 | Haase et al. | 423/556 |
| 4,983,488 | A | 1/1991 | Tan et al. | 430/137 |
| 4,996,127 | A | 2/1991 | Hasegawa et al. | 430/109 |
| 5,066,560 | A | 11/1991 | Tan et al. | 430/137 |
| 5,069,893 | A | 12/1991 | Haase et al. | 423/556 |
| 5,149,400 | A | 9/1992 | Haase et al. | 162/181.6 |
| 5,278,020 | A | 1/1994 | Grushkin et al. | 430/137 |
| 5,290,654 | A | 3/1994 | Sacripante et al. | 430/137 |
| 5,296,213 | A | 3/1994 | Haase et al. | 423/326 |
| 5,308,734 | A | 5/1994 | Sacripante et al. | 430/137 |
| 5,344,738 | A | 9/1994 | Kmiecik-Lawrynowicz et al. | 430/137 |
| 5,346,797 | A | 9/1994 | Kmiecik-Lawrynowicz et al. | 430/137 |
| 5,348,832 | A | 9/1994 | Sacripante et al. | 430/109 |
| 5,364,729 | A | 11/1994 | Kmiecik-Lawrynowicz et al. | 430/137 |
| 5,366,841 | A | 11/1994 | Patel et al. | 430/137 |
| 5,370,963 | A | 12/1994 | Patel et al. | 430/137 |
| 5,403,693 | A | 4/1995 | Patel et al. | 430/137 |
| 5,405,728 | A | 4/1995 | Hopper et al. | 430/137 |
| 5,418,108 | A | 5/1995 | Kmiecik-Lawrynowicz et al. | 430/137 |
| 5,496,676 | A | 3/1996 | Croucher et al. | 430/137 |
| 5,501,935 | A | 3/1996 | Patel et al. | 430/137 |
| 5,527,658 | A | 6/1996 | Hopper et al. | 430/137 |
| 5,585,215 | A | 12/1996 | Ong et al. | 430/107 |
| 5,650,255 | A | 7/1997 | Ng et al. | 430/137 |
| 5,650,256 | A | 7/1997 | Veregin et al. | 430/137 |
| 5,723,253 | A | 3/1998 | Higashino et al. | 430/166 |
| 5,744,520 | A | 4/1998 | Kmiecik-Lawrynowicz et al. | 523/334 |
| 5,474,215 | A | 5/1998 | Ong et al. | 430/137 |
| 5,763,133 | A | 6/1998 | Ong et al. | 430/137 |
| 5,766,818 | A | 6/1998 | Smith et al. | 430/137 |
| 5,804,349 | A | 9/1998 | Ong et al. | 430/110 |
| 5,827,633 | A | 10/1998 | Ong et al. | 430/137 |
| 5,840,462 | A | 11/1998 | Foucher et al. | 430/137 |
| 5,853,944 | A | 12/1998 | Foucher et al. | 430/137 |
| 5,869,215 | A | 2/1999 | Ong et al. | 430/137 |
| 5,994,020 | A | 11/1999 | Patel et al. | 430/137 |
| 6,132,924 | A | 10/2000 | Patel et al. | 430/137 |
| 6,210,853 | B1 * | 4/2001 | Patel et al. | 430/137 |
| 6,268,102 | B1 | 7/2001 | Hopper et al. | 430/137.14 |
| 6,416,920 | B1 * | 7/2002 | Hopper et al. | 430/137.14 |

OTHER PUBLICATIONS

Copending application Ser. No. 08/922,437, filed Sep. 2, 1997, on "Metal–Accelerated Toner Processes", and published in Japan as Publication No. 11153883 on Jun. 8, 1999.

* cited by examiner

*Primary Examiner*—John Goodrow
(74) *Attorney, Agent, or Firm*—E. O. Palazzo

(57) ABSTRACT

A process for the preparation of chemical toner by mixing a colorant, a latex, optionally a wax, and a first coagulant of, for example, a polyaluminum sulfosilicate and a second cationic coagulant of, for example, a benzylalkonium chloride.

35 Claims, No Drawings

TONER COAGULANT PROCESSES

PENDING APPLICATION AND PATENTS

In copending application U.S. Ser. No 08/922,437, filed Sep. 2, 1997, now abandoned, the disclosure which is totally incorporated herein by reference, there is illustrated, for example, a process for the preparation of toner comprising;

(i) aggregating with a metal complex, or metal ion a colorant dispersion with a latex emulsion and optional additives to form aggregates;

(ii) coalescing or fusing the aggregates; and optionally (iii) isolating, washing, and drying the toner.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

In U.S. Pat. No. 6,268,102, the disclosure of which is totally incorporated herein by reference, there is illustrated a process for the preparation of toner comprising mixing a colorant, a latex, and two coagulants, followed by aggregation and coalescence, and wherein one of the coagulants is a polyaluminum sulfosilicate.

Illustrated in U.S. Pat. No. 5,994,020, the disclosure of which is totally incorporated herein by reference, are toner processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles.

The appropriate components and processes of the above recited copending applications and patents may be selected for the processes of the present invention in embodiments thereof.

BACKGROUND OF THE INVENTION

The present invention is generally directed to toner processes, and more specifically, to chemical processes which involve the aggregation and fusion of a resin containing latex, colorant like pigment, or dye, and additive particles into toner particles, and wherein aggregation can be primarily controlled by utilizing a coagulant of polyaluminum sulfosilicate (PASS), which silicate is commercially available, and is believed to be disclosed in U.S. Pat. Nos. 4,981,675; 5,069,893; 5,149,400; 5,296,213, the disclosures of which are totally incorporated herein by reference; and subsequently adding a cationic ionic surfactant as a second co-coagulant, such as SANIZOL B™, that is a benzylalkonium chloride, and wherein there is preferably selected a latex comprised of, for example, submicron resin particles in the size range of, for example, about 0.1 to about 0.5 micron in volume average diameter, suspended in an aqueous phase of water, nonionic and anionic surfactants and optionally suspended in an anionic surfactant to which is added a colorant dispersion comprising, for example, submicron colorant particles in the size range of, for example, about 0.08 to about 0.5 micron in volume average diameter, anionic surfactant, or optionally a nonionic surfactant, or mixtures thereof, and optionally adding thereto a wax dispersion comprising, for example, submicron wax particles in the size range of about 0.1 to about 0.5 micron in volume average diameter suspended in an aqueous phase of water and an anionic surfactant, and wherein the resultant blend is preferably stirred and heated to a temperature below the resin Tg, resulting in aggregates to which is optionally added thereto a second latex, followed by adjusting the pH of the mixture with a base, and heating the mixture to a temperature above the resin Tg, followed by lowering the pH of the mixture with, for example, a metal salt to fuse the aggregates.

More specifically, the present invention is generally directed to the aggregation of latex, colorant and optionally a wax in the presence of polyaluminum sulfosilicate and optionally a coagulant, such as SANIZOL B™, that is benzylalkonium chloride, and wherein the coalescence or fusion of the aggregates is accomplished by a reduction of the pH with an aqueous solution of, for example, aluminum sulfate, and wherein there are generated toner compositions with, for example, a volume average diameter of from about 1 micron to about 25 microns, and preferably from about 2 microns to about 12 microns, and a narrow particle size distribution of, for example, from about 1.10 to about 1.33, and preferably a size distribution in the range of 1.11 to 1.25, the size and size distribution being measured by a Coulter Counter, without the need to resort to conventional pulverization and classification methods. Furthermore, the present invention in embodiments enables minimum washing, for example about 2 to about 4 washings, to provide a suitable toner triboelectrical charge, such as greater than about 20 $\mu$C/g at 20 percent RH. The toners generated can be selected for known electrophotographic imaging and printing processes, including digital color processes.

In the embodiments of the present invention when a co-coagulant, such as SANIZOL B™, is used in conjunction with the polyaluminum sulfosilicate (PASS), the process time may be further reduced by about 30 to about 50 percent as compared, for example, to similar toner processes wherein there is selected polyaluminum sulfosilicate alone. Furthermore, the advantage of using a second coagulant, such as SANIZOL B™, in combination with PASS over polyaluminum chloride (PAC) alone resides in better retention of colorant wherein the colorant is, for example, about 95 to 100 percent retained in the toner particles. Additionally, with the invention processes in embodiments, toner washing can be reduced by about 60 to about 75 percent and the triboelectric charging values of the toner obtained are substantially constant irrespective of the colorant selected. Furthermore, when the toners generated are roll milled and aged over a period of, for example, about 2 to about 3 hours, there results stable and negative toner charging with, for example, no or minimal wrong sign positively charged toner.

The toners generated with the processes of the present invention are especially useful for imaging processes, especially xerographic processes, which usually prefer a toner transfer efficiency in excess of greater than about 90 percent, such as those with a compact machine design without a cleaner or those that are designed to provide high quality colored images with excellent image resolution, acceptable signal-to-noise ratio, and image uniformity. Also, the toners obtained with the processes illustrated herein can be selected for digital imaging systems and processes.

With respect to the prior art, only a small part thereof has been selected and this part may or may not be fully representative of the prior art teachings or disclosures.

PRIOR ART

In xerographic systems, especially color systems, small sized toners of from about 2 to about 8 microns can be of value with regard to the achievement of high image quality for process color applications. Also, of value is the achievement of a low image pile height to eliminate, or minimize image feel and avoid paper curling after fusing. Paper curling can be particularly pronounced in xerographic color processes primarily because of the presence of relatively high toner coverage as a result of the application of three to four colored toners. During fusing, moisture escapes from the paper due to high fusing temperatures of from about 120° C. to about 200° C., and wherein with only one layer of toner selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it can be preferable to select certain toner particle sizes, such as from about 2 to about 10 microns, and with a high colorant, especially pigment loading, such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art includes U.S. Pat. Nos. 3,674,736; 4,137,188 and 5,066,560.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935, 5,723,253, 5,744,520, 5,763,133, 5,766,818, 5,747,215, 5,827,633, 5,853,944, 5,804,349, 5,840,462, 5,869,215. The appropriate components and processes of the above Xerox Corporation patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality.

In another feature of the present invention there is provided a process for preparing toner particles which evidence similar charging behavior despite differential colorant chemistry.

Another feature of the present invention resides in a process for preparing pigmented toner particles with certain coagulants, and wherein the toner is spherical in shape allowing, for example, excellent toner transfer as compared to rough or nonspherical toner.

Yet another feature of the present invention resides in a process of preparing different toner size particles with two coagulants, and wherein minimum amounts of ionic surfactant may be selected.

Additionally, another feature of the present invention resides in a process capable of delivering differing toner morphology particles such as spherical.

A further feature of the present invention resides in the use of a metal salt for the reduction of the pH during coalescence, rather than an acid for the fusion of the aggregates, wherein the use of the metal salts during the pH reduction stage enables rapid spheroidization of the particles when compared to the use of an acid, such as nitric acid, as a pH reducer.

Aspects of the present invention relate to a process comprising (i) blending a colorant dispersion of a colorant, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product; a process comprising (i) blending a colorant dispersion of a colorant, water, and an anionic surfactant, a latex emulsion comprised of resin, water, and an ionic surfactant; and optionally adding a crosslinked gel in the form of a latex, which latex is comprised of a crosslinked resin, water, and an ionic surfactant;

(ii) optionally adding a wax dispersion comprised of submicron wax particles in the size diameter of about 0.1 to about 0.4 micron, and which particles are dispersed in an anionic surfactant of the same charge polarity of the anionic surfactant in the latex emulsion;

(iii) adding to the resulting blend mixture polyaluminum sulfosilicate (PASS) and a cationic co-coagulant with an opposite charge polarity to that of the latex surfactant to thereby initiate flocculation of the latex resin, colorant and, when present, wax;

(iv) heating the resulting mixture below or equal to about the glass transition temperature (Tg) of the latex resin to form toner sized aggregates;

(v) optionally adding a second latex comprised of submicron resin particles suspended in an aqueous phase resulting in an aggregate shell;

(vi) adjusting the pH with a base of from a pH which is in the range of about 1.9 to about 3 to a pH range of about 5 to about 9 to primarily stabilize the aggregates;

(vii) heating the resulting aggregate suspension of (vi) above about the Tg of the latex resin;

(viii) retaining the mixture (vii) at an optional temperature in the range of from about 70° C. to about 95° C. to initiate the fusion or coalescence of the toner aggregates;

(ix) changing the pH of the above (viii) mixture by the addition of a metal salt to arrive at a pH in the range of about 2.8 to about 5 to thereby accelerate the fusion or the coalescence resulting in toner comprised of resin and colorant, wherein the toner particle size is from about 2 to about 25 microns in volume average diameter;

(x) optionally washing the resulting toner slurry; and optionally isolating the toner; a process for the preparation of toner comprising (i) mixing a colorant dispersion of colorant, and an anionic surfactant with a latex emulsion comprised of resin, and an anionic surfactant;

(ii) adding to the resulting blend a first coagulant of polyaluminum sulfosilicate and a second cationic co-coagulant with an opposite charge polarity to that of the latex surfactant;

(iii) heating the resulting mixture below about the glass transition temperature (Tg) of the latex resin;

(iv) optionally adding a second latex comprised of submicron resin particles suspended in an aqueous phase resulting in a coating wherein the coating is optionally of from about 0.1 to about 1 micron in thickness;

(v) adjusting with a base the pH of the resulting mixture from a pH which is in the range of about 1.8 to about 3 to a pH range of about 5 to about 9;

(vi) heating the resulting aggregate suspension of (v) above about the Tg of the latex resin (i);

(vii) changing the pH of the (vi) mixture by the addition of a metal salt to arrive at a pH of from about 2.5 to about 5; optionally heating above the Tg of the resin latex; and isolating the toner; a toner process utilizing an aqueous metal salt solution as a pH reducer to enable spheroidization of toner aggregates that otherwise may not be spheroidizable with the use of normal known pH reducers, such as acids; and wherein the metal salt can also be selected as a pH reducer during coalescence, and wherein the latex resin selected possesses a high molecular weight, for example from about 60,000 to about 1,000,000, and more specifically, from about 70,000 to about 700,000 and an onset glass transition temperature of about 58° C. to about 85° C., and more specifically, about 60° C. to about 75° C.; a process for the preparation of toner compositions, with a volume average diameter of from about 1 to about 25 microns, and more specifically, from about 2 to about 12 microns, and a particle size distribution of about 1.10 to about 1.28, and more specifically, from about 1.15 to about 1.25, each as measured by a Coulter Counter without the need to resort to conventional classifications to narrow the toner particle size distribution; a process for the preparation of pigmented toner particles wherein the latex selected can be prepared by batch polymerization or a semi-batch polymerization process containing submicron resin particles suspended in an aqueous phase of surfactants followed by aggregation in the presence of a dual coagulant comprised of polyaluminum sulfosilicate and a cationic surfactant, such as SANIZOL B™, that is a benzylalkonium chloride; a toner process wherein there are provided toner compositions with low fusing temperatures of from about 140° C. to about 185° C., and which toner compositions exhibit excellent blocking characteristics at and above about, or equal to about 45° C., and which toners generate excellent developed print quality and high resolution color prints; and an emulsion/aggregation toner process providing toner compositions which enable high image projection efficiency, such as for example over 75 percent as measured by the Match Scan II spectrophotometer available from Million-Roy; a process for the preparation of toner comprising mixing a colorant, a latex, a wax and a polyaluminum sulfosilicate or a polyaluminum chloride and a second co-coagulant of, for example, benzylalkonium chloride, alkylbenzyl methyl ammonium chloride, or dialkylbenzenealkyl ammonium chloride; a process for the preparation of toner comprising mixing a colorant, a latex, a wax, and a polyaluminum sulfosilicate and a benzylalkonium chloride as coagulants, and which coagulants assist in permitting aggregation and coalescence of colorant, resin latex, and when present wax; a process for preparing a chemical toner comprising (i) generating a colorant dispersion of a colorant, water, an ionic surfactant, or a nonionic surfactant; a latex emulsion comprised of resin, water, nonionic and ionic surfactant; and wherein the (ii) colorant dispersion is blended with the latex emulsion followed by optionally adding a wax dispersion comprised of submicron particles in the diameter size range of about 0.1 to about 0.5 micron dispersed in an anionic surfactant of the same charge polarity as that of the ionic surfactant in the latex emulsion;

(iii) adding to the resulting blend containing the latex and colorant a coagulant of polyaluminum sulfosilicate (PASS) and a second cationic co-coagulant with an opposite charge polarity to that of the latex surfactant to thereby initiate flocculation of the resin latex and colorant particles;

(iv) heating the resulting mixture below about the glass transition temperature (Tg) of the latex resin to form toner sized aggregates of resin and colorant;

(v) optionally adding a second latex comprised of submicron resin particles suspended in an aqueous phase to the formed toner aggregates of (iv) resulting in a shell wherein the shell is, for example, of from about 0.1 to about 1 micron in thickness;

(vi) adjusting with a base the pH of the resulting toner aggregate mixture from a pH of about 1.9 to about 3 to a pH of about 5 to about 8 to primarily stabilize the aggregate particles;

(vii) heating the resulting aggregate suspension of (vi) above the Tg of the latex resin;

(viii) retaining the mixture (vii) at a temperature in the range of from about 70° C. to about 95° C. for a period of, for example, about 3 to about 10 hours to initiate the fusion or coalescence of the toner aggregates;

(ix) changing the pH of the above (viii) mixture with a metal salt to arrive at a pH in the range of about 2.8 to about 5, and more specifically, about 3 to about 4.5 to accelerate the fusion or the coalescence resulting in toner particles comprised of resin, colorant, and optionally wax, wherein the toner particle size is about 2 about 25 microns;

(x) washing the resulting toner slurry; and (xi) isolating the toner; followed by drying the toner particles; a process comprising (i) mixing a colorant dispersion of a colorant, water, an anionic surfactant with a latex comprised of resin, water, and an ionic surfactant followed by adding a crosslinked gel in the form of a latex and comprised of resin, water, and an ionic surfactant, and wherein the (ii) colorant dispersion is thoroughly blended with the latex emulsion followed by adding a wax dispersion comprised of submicron particles in the size range of about 0.1 to about 0.5 micron dispersed in an anionic surfactant of the same charge polarity as that of the ionic surfactant in the latex emulsion;

(iii) adding to the resulting blend containing the latex and colorant a coagulant of polyaluminum sulfosilicate (PASS) and a second cationic co-coagulant of benzylalkonium chloride having an opposite charge polarity to that of the surfactant latex to thereby initiate flocculation of the resin latex and colorant particles;

(iv) heating the resulting mixture about below or about equal to the glass transition temperature (Tg) of the latex resin to form toner sized aggregates;

(v) optionally adding a second latex comprised of submicron resin particles suspended in an aqueous phase resulting in a shell wherein the shell is, for example, of from about 0.1 to about 1 micron in thickness;

(vi) adjusting with a base the pH of the resulting toner aggregate mixture to about 5 to about 9 to primarily stabilize the aggregate particles;

(vii) heating the resulting aggregate suspension of (vi) above the Tg of the latex resin;

(viii) retaining the mixture (vii) temperature of, for example, from about 70° C. to about 95° C. to initiate the fusion or coalescence of the toner aggregates;

(ix) changing the pH of the above (viii) mixture to arrive at a pH of about 2.8 to about 5, and more specifically, from about 3 to about 4.5 to accelerate the fusion or coalescence resulting in toner particles comprised of resin, colorant, and wax, wherein the toner particle size is about 2 to about 25 microns;

(x) washing the resulting toner slurry; and (xi) isolating the toner; followed by drying the toner particles;

a process wherein a crosslinked gel is added to the latex, and which gel is comprised of styrene-beta carboxyl ethyl acrylate (βCEA), divinyl benzene; a process wherein the amount of divinyl benzene crosslinking agent is from about 0.05 to about 5 percent by weight of resin; a process where the amount of the crosslinked gel latex is from about 5 to about 30 percent by weight of toner; a process wherein the crosslinked gel latex to the linear latex of (i) ratio is about 5:95 to about 30:70 percent by weight of the final toner formulation; a process wherein the final toner formulation is comprised of a linear resin and optionally a crosslinked gel resin and a colorant; a process wherein the polyaluminum sulfosilicate is selected in an amount of from about 0.05 to about 7 percent by weight of toner solids of latex resin, colorant, optional wax and sulfosilicate, and wherein the latex resin, colorant, and wax amount totals about 100 percent; a toner process wherein there is selected a second coagulant of a cationic surfactant; a process wherein the second coagulant selected is, for example, an alkonium benzalkonium chloride, dialkylbenzenealkyl ammonium chloride, alkylbenzyl methyl ammonium chloride or alkylbenzyl dimethyl ammonium bromide and the like in an amount of from about 0.05 to about 5 weight percent by weight; a process wherein the metal salt to reduce the pH of the mixture during the coalescence (vii) is selected, for example, from sulfates, chloride, nitrates, and acetates of aluminum, magnesium, zinc, and potassium; a process wherein the metal salt is aluminum sulfate, aluminum chloride, zinc sulfate, magnesium sulfate, magnesium chloride, potassium-aluminum sulfate, and the preferred metal salt is aluminum sulfate; a process wherein the concentration of the metal salt used to reduce the pH is from about 0.01 to about 10 percent, and more specifically, from about 0.05 to about 7 weight percent by weight of toner; a process wherein the base is a hydroxide selected from the group consisting of sodium hydroxide, potassium hydroxide, and ammonium hydroxide, and wherein a specific base is sodium hydroxide; a process wherein there is added to the formed toner aggregates a second latex comprised of resin particles suspended in an aqueous phase containing an ionic surfactant, and wherein the second latex is selected in an amount of about 10 to about 40 percent by weight of the initial latex and forms a shell or coating on the toner aggregates; a process wherein the added latex contains the same resin as the initial latex, or wherein the added latex contains a dissimilar resin than that of the initial latex; a process wherein the temperature at which the aggregation is accomplished controls the size of the aggregates, and wherein the final toner size is from about 2 to about 15 microns in volume average diameter; a process wherein the aggregation temperature is from about 45° C. to about 60° C., and wherein the coalescence or fusion temperature is from about 85° C. to about 95° C.; a process wherein the colorant is a pigment, and wherein the pigment is in the form of dispersion, and which dispersion contains an ionic surfactant, and wherein the polyaluminum sulfosilicate and the benzylalkonium chloride function as coagulants and enable aggregation of the latex wax and the colorant; a process wherein the coagulant is added during or prior to aggregation of the latex resin and colorant, and which coagulant enables or initiates the aggregation; a process wherein the colorant is carbon black, cyan, yellow, red, green, blue, magenta, or mixtures thereof; a process wherein the toner isolated is from about 2 to about 25 microns in volume average diameter, and the particle size distribution (GSD) thereof is from about 1.15 to about 1.30; and wherein there is added to the surface of the formed toner additives, such as metal salts, metal salts of fatty acids, silicas, metal oxides, or mixtures thereof, each in an amount of from about 0.1 to about 10 weight percent of the obtained toner; a process which comprises mixing a latex, surfactant and colorant; heating in the presence of a polyaluminum sulfosilicate and benzyl alkonium chloride (SANIZOL B™) the resulting mixture below about, or equal to about the glass transition temperature of the latex resin; followed by the addition of a base to stabilize the toner aggregates; thereafter heating the resulting aggregates above about, or about equal to the glass transition temperature of the resin; and isolating, washing and drying the toner; a process wherein prior to isolating the heating is retained at a temperature of from about 70° C. to about 95° C. until fusion or coalescence of the aggregates is accomplished; a process wherein the polyaluminum sulfosilicate possesses a weight average molecular weight of from about 5,000 to about 100,000; a process wherein the sulfosilicate functions as a coagulant and enables or assists in enablement of the aggregation; a process wherein the polyaluminum sulfosilicate is of the formula $$AL_A(OH)_B(SO_4)_C(SIO_X)_D(H_2O)_E$$

where A, B, C, D and E represent the number of segments of each species, and X represents the number of oxygens; a process wherein A is 1, B is from about 0.75 to about 2, C is from about 0.30 to about 1.12, D is from about 0.005 to about 0.1, X is from about 2 to about 4, and E is from about 4 to about 10; a process wherein the aggregation temperature is from about 40° C. to about 62° C., and more specifically, is from about 45° C. to about 58° C.; a process wherein the coalescence temperature is from about 75° C. to about 95° C., and more specifically, about 85° C. to about 90° C.; a process wherein there is added to the aggregate mixture prior to coalescence a base component; a process wherein the base is an alkali metal hydroxide; a process wherein the hydroxide is sodium hydroxide; a process wherein the pH of the mixture resulting after aggregation is increased from about 2 to about 2.6 to about 7 to about 8 during the coalescence, and wherein the base functions primarily as a stabilizer for the toner aggregates during the coalescence; a process wherein the amount of base selected is from about 8 to about 25 weight percent, and more specifically, is from about 10 to about 20 weight percent; a process wherein the amount of metal hydroxide selected is from about 11 to about 14 weight percent; a process wherein the metal salt to reduce the pH is a sulfate, a chloride, a nitrate, or an acetate of aluminum, magnesium, zinc, and potassium; a process wherein the salt is aluminum sulfate, aluminum chloride, zinc sulfate, magnesium sulfate, magnesium chloride, potassium-aluminum sulfate, or zinc acetate, and which salt is selected in an amount of from about 0.05 to about 10 percent, and more specifically, in the amount of about 0.1 about 7 weight percent by weight of toner; a process wherein the latex contains submicron polymer or resin particles containing a polymer selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-dieneacrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process for the preparation of toner particles resulting in images with excellent print quality, and wherein there is selected a latex comprised of submicron resin particles which are in the size range of about 0.05 to about 0.5 micron, and more specifically, in the size range of about 0.07 to about 0.35 micron, suspended in an aqueous water phase containing an ionic surfactant, which is selected in an amount of about 0.5 to about 5 percent, and more specifically, about 0.7 to about 2 percent by weight of solids, to which is added a colorant dispersion comprising submicron, for example less than, or equal to about 0.5 micron, colorant particles, anionic or a nonionic surfactant which is selected in the amount of about 0.5 to about 10 percent, and more specifically, about 0.6 to about 5 percent by weight of solids, which when blended together result in a mixture with a pH of about 2 to about 2.6 to which a polyaluminum sulfosilicate (PASS) solution containing an acid like nitric acid is added slowly over, for example, a period of about 2 to about 5 minutes, followed by the addition of a cationic coagulant surfactant solution of SANIZOL B™ in water wherein the amount of PASS is from about 0.05 to about 0.8 percent by weight of the latex solids and colorant components, and specifically, from about 0.06 to about 0.5 percent by weight; and the second optional coagulant, such as SANIZOL B™, is selected in the amount of about 0.05 to about 0.8 percent by weight of solids, and more specifically, from about 0.06 to about 0.5 percent by weight; further aggregating by stirring and heating from about 5 to about 10 degrees below the resin Tg, resulting in toner aggregates of a size of about 3 to about 15 microns, and more specifically, about 4 to about 8 microns with a narrow GSD of, for example, about 1.14 to about 1.28, and more specifically, about 1.17 to about 1.25, and which improved GSD enables the clean transfer of the toner particles in xerographic systems thereby providing enhanced resolution of the fused images; followed by adjusting the pH of the mixture from about 2 to about 2.6 to a pH of about 6 to about 9, and more specifically, to about 7 to about 8.5, or to a pH of about 8 with the addition of a dilute base solution of 4 weight percent of sodium hydroxide to primarily stabilize the aggregates, further stirring and increasing the mixture temperature above the resin Tg, in the range of about 70° C. to about 95° C., and more specifically, from about 85° C. to about 93° C. for a period of about 0.5 to about 1.5 hours, followed by changing the pH from about 8 to about 4.5 by the use of an aqueous metal salt solution, such as a dilute solution of aluminum sulfate in water wherein the concentration of aluminum sulfate is from about 0.5 to about 5 weight percent, and more specifically, about 0.75 to about 3.5 weight percent, and heating the mixture for an additional about 0.5 to about 4 hours, and more specifically, from about 0.6 to about 3 hours, to fuse or coalesce the aggregates, and then washing and drying the toner; a toner process wherein a wax dispersion is added to the latex and colorant mixture; a process wherein the use of an aqueous solution of a metal salt to reduce the pH of step (ix) enables rapid spheroidization of the toner particles; and the rapid spheroidization with the use of a metal salt as a pH reducer enhances by about 2 to about 4 times faster than that when an acid is selected; and a process for the preparation of toner compositions which comprises blending an aqueous colorant dispersion containing a pigment, such as carbon black, phthalocyanine, quinacridone or RHODAMINE B™ type, red, green, orange, brown, violet, yellow, fluorescent colorants and the like, with a latex emulsion derived from the emulsion polymerization of monomers selected, for example, from the group consisting of styrene, butadiene, acrylates, methacrylates, acrylonitrile, acrylic acid, methacrylic acid, itaconic or Beta Carboxy Ethyl Acrylate (βCEA) and the like, and which latex contains an ionic surfactant, such as sodium dodecylbenzene sulfonate, and optionally a nonionic surfactant, and which process is accomplished in the presence of a metal salt, or PASS and a second coagulant cationic surfactant, heating the resulting flocculent mixture at a temperature below the resin Tg for an effective length of time of, for example, about 0.5 hour to about 3 hours to form toner sized aggregates; and optionally adding a known amount of delayed latex wherein the latex can be the same as the above initial latex or dissimilar, followed by adjusting the pH of the mixture with a dilute base solution of sodium hydroxide, and subsequently heating the aggregate suspension at a temperature at or below 95° C. for a period of 0.5 to 1 hour, adjusting the pH of the mixture from about 8 to about 4.5 with an aqueous dilute metal salt of aluminum sulfate to provide spherical toner particles, isolating the toner product by, for example, filtration, washing and drying in an oven, fluid bed dryer, freeze dryer, or spray dryer.

The particle size of the toner provided by the processes of the present invention in embodiments can be controlled, for example, by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The crosslinked gel latex when selected can contain divinyl benzene as an additional monomer during the latex formation. The latex polymer, or resin is generally present in the toner compositions of the present invention in various suitable amounts, such as from about 75 weight percent to about 98, or from about 80 to about 95 weight percent of the toner or of the solids, and the latex size suitable for the processes of the present invention can be, for example, more specifically, from about 0.05 micron to about 0.7 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Examples of waxes include those as illustrated herein, such as those disclosed in the aforementioned copending applications, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected have, it is believed, a molecular weight $M_w$ of from about 1,000 to about 1,500, while the commercially available polypropylenes are believed to have a molecular weight of from about 4,000 to about 5,000. Examples of functionalized waxes include, amines, amides, for example aqua SUPERSLIP 6550, SUPERSLIP 6530 available from Micro Powder Inc., fluorinated waxes, for example POLYFLUO 190, POLYFLUO 200, POLYFLUO 523XF, AQUA POLYFLUO 411, AQUA POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, chlorinated polypropylenes and polyethylenes commercially available from Allied Chemical and Petrolite Corporation and SC Johnson wax.

Various known colorants, such as pigments, selected for the processes of the present invention and present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL. Colored magnetites, such as mixtures of MAPICO BLACK™, and cyan components may also be selected as pigments for the processes of the present invention, wherein the pigment amount is in the range of 3 to 15 weight percent of the toner. Dye examples include known suitable dyes, reference the Color Index, and a number of U.S. patents, such as food dyes, and the like.

Colorants include pigment, dye, mixtures of pigment and dyes, mixtures of pigments, mixtures of dyes, and the like.

Examples of initiators for the latex preparation include water soluble initiators, such as ammonium and potassium persulfates, in suitable amounts, such as from about 0.1 to about 8 percent, and more specifically, from about 0.2 to about 5 percent (weight percent). Examples of organic soluble initiators include VAZO peroxides, such as VAZO 64, 2-methyl 2-2'-azobis propanenitrile, VAZO 88, 2-2'-azobis isobutyramide dehydrate in a suitable amount, such as from about 0.1 to about 8 percent. Examples of chain transfer agents include dodecane thiol, octane thiol, carbon tetrabromide and the like in various suitable amounts, such as from about 0.1 to about 10 percent, and more specifically, from about 0.2 to about 5 percent by weight of monomer.

Surfactants for the preparation of the latexes and the colorant dispersions can be ionic or nonionic surfactants, in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride) available from Kao Chemicals, and the like, selected in effective amounts of, for example, from about 0.01 percent to about 10 percent by weight. The molar ratio of the cationic surfactant used for flocculation to the anionic surfactant used in the latex preparation is, for example, from about 0.5 to about 4.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) thanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected.

Examples of the first coagulant are polyaluminum sulfosilicates, which, for example, can be represented by the formula $$AL_A(OH)_B(SO_4)_C(SIO_X)_D(H_2O)_E$$

wherein

A is the number of Al segments and can be a number of about 1 to about 2;

B is a number of from about 0.75 to about 2;

C is from about 0.30 to about 1.12;

D is from about 0.005 to about 0.1;

X is a number equal to or greater than 2 but less than or equal to about 4 wherein 3=B+2C+2D (X-2); and E is a number of larger than about 4, such as from about 5 to about 10, or more generally, wherein A, B, C, D, X and E represent the number of segments or atoms with respect to X, which represents the number of oxygen atoms.

Examples of the second surfactant coagulant are dialkyl benzenealkyl ammonium chloride, lauryl trimethyl ammonium chloride, alkylbenzyl methyl ammonium chloride, alkyl benzyl dimethyl ammonium bromide, and the like, and wherein alkyl contains, for example, from about 5 to about 20 carbon atoms, with the amounts of each of the first and second coagulant being from about 0.03 percent to about 1 percent by weight of toner aggregates, and more specifically, from about 0.05 to about 0.5 percent by weight of toner aggregates.

Examples of metal salts used as a pH reducer for (ix) can be selected from, for example, halides like chlorides, sulfates, nitrates, and acetates of aluminum, magnesium, zinc, and potassium, and more specifically, wherein the salt is aluminum sulfate, aluminum chloride, zinc sulfate, magnesium sulfate, magnesium chloride, or potassium-aluminum sulfate, or water soluble metal salts, that is metal salts that are readily soluble in water.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Specific additives include zinc stearate and AEROSIL R972® available from Degussa. The coated silicas of U.S. Pat. No. 6,190,815 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes of the present invention, from about 2 percent toner concentration to about 8 percent toner concentration, with known carrier particles, including coated carriers, such as steel, ferrites, and the like, reference U.S. Pat. Nos. 4,937,166 and 4,935,326, the disclosures of which are totally incorporated herein by reference. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,990; 4,858,884; 4,584,253 and 4,563,408, the disclosures of which are totally incorporated herein by reference.

The following Examples are provided. Percentages are by weight, and all temperatures are in degrees Centigrade.

EXAMPLES

Latex Preparation—Semicontinuous Method

Latex (Linear Latex) A:

A latex emulsion comprised of polymer particles generated from the emulsion polymerization of styrene, butyl acrylate and beta carboxyl ethyl acrylate (β)CEA was prepared as follows. A surfactant solution of 1.59 kilograms of DOWFAX 2A1 (anionic emulsifier) and 430 kilograms of deionized water was prepared by mixing these components for 10 minutes in a stainless steel holding tank. The holding tank was then purged with nitrogen for 5 minutes before transferring into a reactor. The reactor was then continuously purged with nitrogen while being stirred at 100 RPM. The reactor was then heated to 80° C. at a controlled tare, and held there. Separately, 6.8 kilograms of ammonium persulfate initiator were dissolved in 33.55 kilograms of deionized water.

Separately, a monomer emulsion was prepared in the following manner. 366 kilograms of styrene, 86 kilograms of butyl acrylate, 14 kilograms of β-CEA, 6.0 kilograms of 1-dodecanethiol, 3 kilograms of dodecanediol diacrylate (ADOD), 8.05 kilograms of DOWFAX (anionic surfactant), and 216 kilograms of deionized water were mixed to form an emulsion. 5 Percent of the emulsion was then slowly fed into the reactor containing the above aqueous surfactant phase at 80° C. to form "seeds" while being purged with nitrogen. The initiator solution was then slowly charged into the reactor and after 10 minutes the remainder of the emulsion was continuously fed into the reactor with metering pumps.

Once all the monomer emulsion was charged into the main reactor, the temperature was held at 80° C. for an additional 2 hours to complete the reaction. Full cooling was then applied and the reactor temperature was reduced to 35° C. The product was collected into a holding tank. After drying the latex, the resin molecular properties were $M_w$=60,000, $M_n$=10.8 and the onset Tg was 57.5° C. The latex was comprised of 40 percent resin, 58.5 percent water and 1.5 percent anionic surfactant.

Latex B:

A crossed latex emulsion comprised of crosslinked polymer particles derived from the emulsion polymerization of styrene, divinylbenzene and beta carboxyl ethyl acrylate (βCEA) was prepared as follows. An aqueous phase was prepared by dissolving 6 grams of NEOGEN® in 500 milliliters of water. This mixture was then heated to 75° C. with stirring under a nitrogen atmosphere in a 2 liter Buchi reactor. An emulsion of 271 grams of styrene, 2.7 grams of divinylbenzene, 8.1 grams of beta CEA, 14.1 grams of NEOGEN® and 230 grams of water was then prepared. 12 Grams of this emulsion were added to the above aqueous crosslinked phase in the reactor at 75° C., followed by the addition of an aqueous solution of 4.25 grams of ammonium persulfate in 45 grams of water. The mixture resulting was then heated at 75° C. in the above Buchi reactor with stirring under nitrogen for a period of 15 minutes, and then the above emulsion was slowly added to this mixture over a period of 2 hours. After addition, the emulsion was heated for a further 2 hours, cooled and discharged. The resulting latex provided a yield of 26 percent solids of a crosslinked resin comprised of styrene—βCEA and divinyl benzene in the ratio of 96.1:2.9:1 percent by weight of toner in water. The particle size of the resin latex was 30 nanometers as measured on a Nicomp 360 particle sizer.

Preparation of a Crosslinked Latex:

A crosslinked latex resin emulsion comprised of crosslinked resin or polymer particles derived from the emulsion polymerization of styrene, butyl acrylate, beta carboxyl ethyl acrylate (Beta CEA) and divinylbenzene was prepared as follows. An organic phase was prepared by blending 380 grams of styrene, 162 grams of butyl acrylate, 16.2 grams of beta carboxyl ethyl acrylate (Beta CEA) and 5.4 grams of divinylbenzene. An aqueous phase was then prepared by mixing 9.4 grams of the surfactant DOWFAX® in 230 grams of water. The organic phase was then added to the aqueous phase and the resulting mixture was stirred to form an oil in water dispersion. To a 2 liter Buchi stainless steel reactor equipped with a stirrer, a thermocouple and a nitrogen inlet was added an aqueous solution of a surfactant, and 2 grams of DOWFAX® in 500 grams of water. The reactor was heated to 75° C. under a nitrogen atmosphere with stirring (300 rpm). To the reactor was then added 14 grams of the above prepared oil in water dispersion followed by the addition of an aqueous solution of 8.5 grams of ammonium persulfate in 90 grams of water. The resulting mixture was stirred for 10 minutes at 75° C., and then the remainder of the above oil in water dispersion was added slowly over a two hour period. After the complete addition of the oil in water dispersion to the reactor, the resulting mixture was heated for a further two hours to complete the polymerization, cooled to room temperature, about 25° C. and discharged to yield a crosslinked polymer latex with a polymer of a styrene butyl acrylate divinylbenzene polymer, which polymer was fully crosslinked, about 100 percent crosslinked, 40 percent polymer solids in water with a polymer particle diameter size of 114 nanometers as measured by a disc centrifuge.

TONER PREPARATION EXAMPLES

Example I

Preparation of Cyan Toner with Aluminum Sulfate:

330 Grams of the above prepared latex emulsion (Latex A) and 150 grams of an aqueous cyan pigment dispersion containing 45 grams of blue pigment PB 15.3 having a solids loading of 50.9 percent, were simultaneously added to 600 milliliters of water at room temperature, about 25° C., while being mixed at a shear speed of 5,000 rpm by means of a polytron. To this mixture were added 11.25 grams of a polyaluminum sulfosilicate (PASS) solution containing 1.25 grams of 10 percent solids and 10 grams of 0.2 molar nitric acid, over a period of 1 minute, followed by the addition of 11.25 grams of a cationic surfactant solution containing 1.25 grams of the coagulant benzylalkonium chloride (SANIZOL B™—60 percent active ingredients) and 10 grams of deionized water followed by blending at a speed of 5,000 rpm for a period of 2 minutes. The resulting mixture was transferred to a 2 liter reaction vessel and heated at a temperature of 50° C. for 180 minutes resulting in aggregates of a size of 6.1 microns and a GSD of 1.16. To the toner aggregates were added 130 grams of the above prepared latex (Latex A) followed by stirring for an additional 30 minutes and the particle size was found to be 6.4 and a GSD of 1.17. The pH of the resulting mixture was then adjusted from about 2 to about 7.9 by the addition of an aqueous base solution of 4 percent sodium hydroxide and the resulting mixture was allowed to stir for an additional 15 minutes. Subsequently, the resulting mixture was heated to 90° C. and retained there for a period of 1 hour. To the resulting mixture, 1 gram of aluminum sulfate dissolved in 10 grams of water was added resulting in a reduction of the pH from about 7.6 to about 4.8. After 3.5 hours (total) at a temperature of 90° C. the particles were in the form of spheres and had a size of 6.3 microns with a GSD of 1.18 as observed under the optical microscope. The reactor was then cooled down to room temperature and the particles were washed 4 times, where the first wash was conducted at pH of 11, followed by 2 washes with deionized water, and the last wash carried out at a pH of 4. The toner particles were then dried on a freeze dryer. The toner particles were comprised of 89 percent resin of Latex (A) and 11 percent of the above pigment.

Example II

Preparation of Red Toner With Aluminum Sulfate Coagulant:

330 Grams of the above prepared latex emulsion (Latex A) and 150 grams of an aqueous cyan pigment dispersion containing 62 grams of red pigment PR 22 having a solids loading of 43.4 percent were simultaneously added to 600 milliliters of water with high shear stirring by means of a polytron. To this mixture were added 11.75 grams of a polyaluminum sulfosilicate (PASS) solution containing 1.75 grams of 10 percent solids and 10 grams of 0.2 molar nitric acid, over a period of 1 minute, followed by the addition of 11.75 grams of a cationic surfactant solution containing 1.75 grams of the coagulant benzylalkonium chloride (SANIZOL B™—60 percent active ingredients) and 10 grams of deionized water, and which mixture was blended at speed of 5,000 rpm for a period of 2 minutes. The resulting mixture was transferred to a 2 liter reaction vessel and heated at a temperature of 50° C. for 200 minutes resulting in aggregates of a size diameter of 6.7 microns and a GSD of 1.19. To the formed toner aggregates were added 130 grams of the above prepared latex (Latex A) followed by stirring for an additional 30 minutes. The resulting polymer particle size was found to be 6.6 with a GSD of 1.19. The pH of the resulting mixture was then adjusted from 2 to 7.9 with an aqueous base solution of 4 percent sodium hydroxide and allowed to stir for an additional 15 minutes. Subsequently, the resulting mixture was heated to 90° C. and retained there for a period of 1 hour. To the resultant mixture, 1 gram of aluminum sulfate dissolved in 10 grams of water was added resulting in a reduction of the pH from about 7.5 to about 4.5. After 3.5 hours (total) and at a temperature of 90° C. the toner particles were in the shape of spheres and had a size of 6.6 microns with a GSD of 1.20 when observed under the optical microscope. The reactor was then cooled down to room temperature, 25° C., and the particles were washed 4 times, where the first wash was conducted at pH of 11, followed by 2 washes with deionized water, and a last wash carried out at a pH of 4. The toner particles were then dried on a freeze dryer. The toner obtained was comprised of 87.2 percent of the resin of Latex (A) and 12.8 percent pigment.

Example III

Preparation of Cyan Toner With Reduced Amount of Aluminum Sulfate:

330 Grams of the above prepared latex emulsion (Latex A) and 150 grams of an aqueous cyan pigment dispersion containing 45 grams of blue pigment PB 15.3 having a solids loading of 50.9 percent were simultaneously added to 600 milliliters of water with high shear stirring by means of a polytron. To this mixture were added 11.25 grams of a polyaluminum sulfosilicate (PASS) solution containing 1.25 grams of 10 percent solids and 10 grams of 0.2 molar nitric acid, over a period of 1 minute, followed by the addition of 11.25 grams of a cationic surfactant solution containing 1.25 grams of the coagulant SANIZOL B™ (60 percent active ingredients) and 10 grams of deionized water followed by blending at speed of 5,000 rpm for a period of 2 minutes. The resulting mixture was transferred to a 2 liter reaction vessel and heated at a temperature of 53° C. for 130 minutes resulting in aggregates of a size of 5.8 microns and a GSD of 1.18. To the formed toner aggregates were added 130 grams of the above prepared latex (Latex A) followed by stirring for an additional 30 minutes. The particle size of the polymer was found to be 6 with a GSD of 1.16. The pH of the resulting mixture was then adjusted from about 2 to about 7.9 with an aqueous base solution of 4 percent sodium hydroxide and allowed to stir for an additional 15 minutes. Subsequently, the resulting mixture was heated to 90° C. and retained there for a period of 1 hour. To the resulting mixture 0.5 gram of aluminum sulfate dissolved in 50 grams of water was added resulting in a reduction of the pH from about 7.2 to about 5.1. After 5 hours (total) at a temperature of 90° C., the particles possessed a smooth surface morphology and had a size of 6.3 microns with a GSD of 1.18. The reactor was then cooled down to room temperature and the toner particles were washed 4 times, where the first wash was conducted at pH of 11, followed by 2 washes with deionized water, and the last wash carried out at a pH of 4. The particles were then dried on a freeze dryer. The toner resulting was comprised of 89 percent resin of Latex (A) and 11 percent of the above pigment.

Example IV

Preparation of a Crosslinked Gel Cyan Toner With Aluminum Sulfate:

226.5 Grams of the above prepared latex emulsion (Latex A) to which 103.5 grams of a crosslinked, about 100 percent crosslinked, resin Latex (B) and 150 grams of an aqueous cyan pigment dispersion containing 45 grams of blue pigment PB 15.3 having a solids loading of 50.9 percent were simultaneously added to 600 milliliters of water with high shear stirring by means of a polytron. To this mixture were added 11.25 grams of a polyaluminum sulfosilicate (PASS) solution containing 1.25 grams of 10 percent solids and 10 grams of 0.2 molar nitric acid over a period of 1 minute, followed by the addition of 11.25 grams of a cationic surfactant solution containing 1.25 grams of the coagulant SANIZOL B™ (60 percent active ingredients) and 10 grams of deionized water and blended at a speed of 5,000 rpm for a period of 2 minutes. The resulting mixture was transferred to a 2 liter reaction vessel and heated at a temperature of 53° C. for 200 minutes resulting in aggregates of a size of 6.8 microns and a GSD of 1.20. To the formed toner aggregates were added 130 grams of the above prepared latex (Latex A) followed by stirring for an additional 30 minutes at which time the particle size was found to be 6.9 with a GSD of 1.20. The pH of the resulting mixture was then adjusted from about 2 to about 7.9 with aqueous base solution of 4 percent sodium hydroxide and allowed to stir for an additional 15 minutes. Subsequently, the resulting mixture was heated to 90° C. and retained there for a period of 1 hour. To the resultant mixture 1 gram of aluminum sulfate dissolved in 10 grams of water was added resulting in a reduction of the pH from about 7.5 to about 4.5. After 6 hours (total) at a temperature of 90° C., the toner particles resulting were very smooth and had a size of 7 microns with a GSD of 1.21 as observed under an optical microscope with respect to the toner spherical shape. The reactor was then cooled down to room temperature and the toner particles washed 4 times, where the first wash was conducted at pH of 11, followed by two washes with deionized water, and a last wash carried out at a pH of 4. Throughout the Examples, all washes were accomplished with deionized water unless specifically indicated otherwise. The particles were then dried on a freeze dryer. The toner product resulting was comprised of 69 percent of Latex (A), 20 percent of Latex (B), and 11 percent of the above pigment Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process comprising (i) blending a colorant dispersion of a colorant, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

2. A process comprising (i) blending a colorant dispersion of a colorant, water, and an anionic surfactant, a latex emulsion comprised of resin, water, and an ionic surfactant; and optionally adding a crosslinked gel in the form of a latex, which latex is comprised of a crosslinked resin, water, and an ionic surfactant;

(ii) optionally adding a wax dispersion comprised of submicron wax particles in the size diameter of about 0.1 to about 0.4 micron, and which particles are dispersed in an anionic surfactant of the same charge polarity of the anionic surfactant in the latex emulsion;

(iii) adding to the resulting blend mixture polyaluminum sulfosilicate (PASS) and a cationic co-coagulant with an opposite charge polarity to that of the latex surfactant to thereby initiate flocculation of the latex resin, colorant and, when present, wax;

(iv) heating the resulting mixture below or equal to about the glass transition temperature (Tg) of the latex resin to form toner sized aggregates;

(v) optionally adding a second latex comprised of submicron resin particles suspended in an aqueous phase resulting in an aggregate shell;

(vi) adjusting the pH with a base of from a pH which is in the range of about 1.9 to about 3 to a pH range of about 5 to about 9 to primarily stabilize the aggregates;

(vii) heating the resulting aggregate suspension of (vi) above about the Tg of the latex resin;

(viii) retaining the mixture (vii) at an optional temperature in the range of from about 70° C. to about 95° C. to initiate the fusion or coalescence of the toner aggregates;

(ix) changing the pH of the above (viii) mixture by the addition of a metal salt to arrive at a pH in the range of about 2.8 to about 5 to thereby accelerate the fusion or the coalescence resulting in toner comprised of resin and colorant, wherein the toner particle size is from about 2 to about 25 microns in volume average diameter;

(x) optionally washing the resulting toner slurry; and optionally isolating the toner.

3. A process in accordance with claim 1 wherein said polyaluminum sulfosilicate is selected in an amount of from about 0.05 to about 5 percent by weight of product, and which product is a toner.

4. A process in accordance with claim 1 wherein said second co-coagulant is selected in the amount of from about 0.1 to about 5 percent by weight of toner, and wherein said toner is comprised of said latex resin, said colorant and said wax, and wherein the total of said components is about 100 percent.

5. A process in accordance with claim 1 wherein said base is selected from the group consisting of sodium hydroxide, potassium hydroxide, and ammonium hydroxide.

6. A process in accordance with claim 1 (ii) wherein there is added a crosslinked resin latex in an amount of from about 5 to about 30 percent by weight of toner.

7. A process in accordance with claim 6 wherein the crosslinked latex gel latex comprises submicron resin particles suspended in an aqueous phase of water and ionic surfactant, and wherein the submicron resin particles are of a size diameter of from about 0.1 to about 0.5 micron.

8. A process in accordance with claim 1 (viii) wherein the pH reduction is conducted with a metal salt of aluminum sulfate, aluminum chloride, zinc sulfate, magnesium sulfate, magnesium chloride, or potassium-aluminum sulfate.

9. A process in accordance with claim 8 wherein the amount of the metal salt is from about 0.05 to about 7 percent by weight of toner product.

10. A process in accordance with claim 1 wherein there are formed toner aggregates in (v) and there is added to the formed toner aggregates a second latex comprised of submicron resin particles suspended in an aqueous phase containing an ionic surfactant, and wherein said second latex is selected in an amount of about 10 to about 40 percent by weight of latex (i), and said second latex resin forms a shell or coating on said aggregates.

11. A process in accordance with claim 10 wherein the thickness of the shell or coating is from about 0.1 to about 1 micron.

12. A process in accordance with claim 10 wherein the second latex contains the same resin as latex (i), or wherein the second latex contains a dissimilar resin than that of latex (i).

13. A process in accordance with claim 1 wherein (iv) is accomplished by heating at a temperature below about the glass transition temperature of the resin contained in latex (i), and the mixture (v) is retained at a temperature of from about 70° C. to about 95° C. for an optional period of about 3 hours to about 20 hours; and wherein following said heating in (vi) there results coalescence of resin and colorant.

14. A process in accordance with claim 13 wherein said heating (iv) at a temperature of from about 40° C. to about 60° C. results in toner aggregates, and wherein the temperature (vi) is from about 75° C. to about 97° C.

15. A process in accordance with claim 1 wherein the pH of the mixture resulting in (v) is increased from an initial about 2 to about 2.6 to a final about 5 to about 8, and wherein said base functions primarily as a stabilizer, and no or minimal particle size or GSD increase results.

16. A process in accordance with claim 1 wherein the colorant is a pigment, and wherein said pigment is in the form of dispersion, and which dispersion contains an ionic surfactant.

17. A process in accordance with claim 1 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid).

18. A process in accordance with claim 2 wherein the crosslinked resin latex contains an additional monomer of a divinyl benzene in an amount of about 0.05 to about 3.0 weight percent of said resin, and wherein said crosslinking is from about 90 to about 100 percent.

19. A process in accordance with claim 1 wherein the colorant is carbon black, cyan, yellow, magenta, or mixtures thereof; the product isolated is a toner of from about 2 to about 15 microns in volume average diameter; and wherein there is optionally added to the surface of the formed toner metal salts, metal salts of fatty acids, silicas, metal oxides, or mixtures thereof, each in an amount of from about 0.1 to about 10 weight percent of the obtained toner.

20. A process in accordance with claim 1 wherein said polyaluminum sulfosilicate possesses a weight average molecular weight of from about 5,000 to about 100,000.

21. A process in accordance with claim 1 wherein said polyaluminum sulfosilicate is of the formula $$Al_A(OH)_B(SO_4)_C(SIO_X)_D(H_2O)_E$$

where A, B, C, D and E represent the number of segments, and X represents the number of oxygens.

22. A process in accordance with claim 21 wherein A is 1, B is from about 0.75 to about 2, C is from about 0.30 to about 1.12, D is from about 0.005 to about 0.1, and X is from about 2 to about 4.

23. A process for the preparation of toner comprising (i) mixing a colorant dispersion of colorant, and an anionic surfactant with a latex emulsion comprised of resin, and an anionic surfactant;

(ii) adding to the resulting blend a first coagulant of polyaluminum sulfosilicate and a second cationic co-coagulant with an opposite charge polarity to that of the latex surfactant;

(iii) heating the resulting mixture below about the glass transition temperature (Tg) of the latex resin;

(iv) optionally adding a second latex comprised of submicron resin particles suspended in an aqueous phase resulting in a coating wherein the coating is optionally of from about 0.1 to about 1 micron in thickness;

(v) adjusting with a base the pH of the resulting mixture from a pH which is in the range of about 1.8 to about 3 to a pH range of about 5 to about 9;

(vi) heating the resulting aggregate suspension of (v) above about the Tg of the latex resin (i);

(vii) changing the pH of the (vi) mixture by the addition of a metal salt to arrive at a pH of from about 2.5 to about 5; optionally heating above the Tg of said resin latex; and isolating said toner.

24. A process in accordance with claim 1 wherein there is selected as second coagulant a cationic coagulant selected from the group consisting of an alkylonium benzalalkylkonium chloride, dialkylbenzenealkyl ammonium chloride, alkylbenzyl methyl ammonium chloride and alkylbenzyl dimethyl ammonium bromide.

25. A process in accordance with claim 1 wherein said second cationic coagulant is a benzylalkonium chloride.

26. A process in accordance with claim 1 wherein said toner is washed, isolated and dried.

27. A process in accordance with claim 1 wherein said resin of latex (i) possesses a weight average molecular weight of from about 80,000 to about 250,000, and wherein said resin possesses a glass transition temperature of from about 60° C. to about 70° C.

28. A process in accordance with claim 1 wherein there is selected a nonionic surfactant.

29. A process in accordance with claim 1 wherein there is selected an anionic surfactant.

30. A process in accordance with claim 1 wherein said product is a toner comprised of resin and colorant.

31. A process in accordance wit claim 1 wherein said latex contains a resin of styrene/butyl acrylate/beta carboxyl ethyl acrylate.

32. A process in accordance with claim 1 wherein said latex contains a crosslinked polymer.

33. A process in accordance with claim 32 wherein said crosslinked polymer is generated from the emulsion polymerization of styrene, divinylbenzene and beta carboxyl ethyl acrylate.

34. A process in accordance with claim 1 wherein the amount of each of said first coagulant and second coagulant is from about 0.05 to about 0.5 percent by weight.

35. A toner process comprising (i) blending a colorant dispersion of a colorant, water, and an anionic surfactant;

(ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below the glass transition temperature (Tg) of the latex resin;

(v) adjusting with a base the pH of t a resulting toner aggregate mixture from a pH which is about 1.8 to about 3 to a pH range of about 5 to about 9;

(vi) heating above the Tg of the latex resin;

(vii) changing the pH of the mixture by the addition of a metal salt to arrive at a pH of from about 2.8 to about 5; and (viii) isolating the product, and wherein said resin is a crosslinked resin.

* * * * *